US005833229A

United States Patent [19]

Prim

[11] Patent Number: 5,833,229

[45] Date of Patent: Nov. 10, 1998

[54] BINDERY FEEDER AND METHOD OF OPERATION

[75] Inventor: John E. Prim, West Chazy, N.Y.

[73] Assignee: Prim Hall Enterprises, Inc., Plattsburgh, N.Y.

[21] Appl. No.: 688,195

[22] Filed: Jul. 29, 1996

[51] Int. Cl.[6] ..... B65H 5/08

[52] U.S. Cl. ..... 271/11; 271/10.03; 271/100; 271/258.01; 271/270; 271/277

[58] Field of Search ..... 271/10.03, 11, 271/258.01, 262, 263, 270, 277, 99, 100

[56] References Cited

U.S. PATENT DOCUMENTS

| | | | |
|---|---|---|---|
| 4,799,661 | 1/1989 | Nail | 271/263 X |
| 4,836,528 | 6/1989 | Geiser | 271/263 |
| 4,982,947 | 1/1991 | Milne | 271/263 |
| 5,007,628 | 4/1991 | Skinner | 271/263 |
| 5,011,128 | 4/1991 | Tsuji | 271/263 |
| 5,092,236 | 3/1992 | Prim et al. . | |
| 5,174,559 | 12/1992 | Diamantides . | |
| 5,197,590 | 3/1993 | Prim et al. . | |
| 5,238,240 | 8/1993 | Prim et al. . | |
| 5,299,795 | 4/1994 | Miyake | 271/270 X |
| 5,366,215 | 11/1994 | Hastie et al. . | |
| 5,374,050 | 12/1994 | Prim . | |
| 5,394,979 | 3/1995 | Hall et al. . | |
| 5,599,014 | 2/1997 | Kitahara et al. | 271/263 X |

FOREIGN PATENT DOCUMENTS

| | | | |
|---|---|---|---|
| 132167 | 5/1993 | Japan | 271/270 |

*Primary Examiner*—Boris Milef
*Attorney, Agent, or Firm*—Peninsula IP Group; Douglas A. Chaikin, Esq.

[57] ABSTRACT

A feeder for feeding material along a feed path. The feeder includes a conveyer, a sensor and a control system. The conveyer operates at a normal cyclical rate to transfer the material along the feed path. The sensor mounts on the feeder and detects the material being fed. The sensor detects and signals fault when the material is fed in an undesirable manner. The control system couples with the conveyer and with the sensor and responds to the sensor to slow the conveyer to a reduced cyclical rate when the sensor signals fault. The reduced cyclical rate is less than the normal cyclical rate to enable the feeder to self-correct and thereby eliminate the fault. When the conveyer operates at the reduced cyclical rate and the feeder has self-corrected, the sensor ceases to detect fault and the control system speeds the conveyer back to the normal cyclical rate.

7 Claims, 6 Drawing Sheets

BINDERY FEEDER AND METHOD OF OPERATION

CROSS-REFERENCE TO RELATED PATENTS

The present invention relates in subject matter U.S. Pat. No. 5,336,215 to Hastie et al.; U.S. Pat. No. 5,174,559 to Diamamtides; U.S. Pat. No. 5,349,979 to Hall et al.; U.S. Pat. No. 5238,240 to Prim et al.; U.S. Pat. No. 5,197,590 to Prim et al.; U.S. Pat. No. 5,374,050 to Prim; and 5,092,236 to Prim et al. The disclosures of each related patent is incorporated herein by reference.

BACKGROUND OF THE INVENTION

1. Field of the Invention

This invention relates generally to feeders for bindery machine systems. More particularly this invention relates to feeders having an automated shutdown and re-start systems.

2. Previous Art

A known feeder apparatus for feeding sheets of material is disclosed in U.S. Pat. No. 5,174,559, the disclosure of which is incorporated herein by reference. This apparatus includes a hopper which supports stacked sheets of material. A separator is engagable with the sheets of material to pull single sheets of material down towards a pickup location. A feed drum has a plurality of spaced apart grippers which sequentially grip the sheets of material at the pickup location. The feed drum pulls the sheets of material to transfer the material along a feed path.

With known feeders, faults in the feeding process may occur. Typical faults include mis-feeds where the sheets of material fail to be fed. Other faults include the situation where an inappropriate number of sheets of material is fed. For example, double feeds may occur when two sheets of material are fed instead of one. Mis-feeds, double feeds and other faults may cause delay and may compromise the reliability of any process relying on the feeder. One potential cause for such faults becomes apparent when the material to be fed is wrinkled or folded. The separator may fail to properly grip and pull wrinkled or folded material.

To minimize delay and maximize reliability, some feeders include a control system and sensors. The sensor detects fault such as mis-feeds and double feeds, for example. Upon detection of a fault, the control system shuts the feeder down so that corrective measures may be implemented. This way insures that material is properly fed. However, stopping the feeder wastes time.

The feeder typically will not stop abruptly, but instead, will cycle a few times and gradually slow to a stop. In some cases, such as where a single unit of material is wrinkled or folded, slowing the feeder will allow the feeder to properly feed the material. Notwithstanding the capability of the feeder to properly feed material when the feeder slows, some automated systems will slow and then shut down notwithstanding the fact that the fault has been corrected. Time is wasted when the feeder is shut down. Feeder shutdown may delay the production of time sensitive material such as books, magazines and newsletters. Delays in production are generally undesirable and sought to be minimized. What is desired is a feeder which does not stop when material begins to properly feed after a fault is detected.

SUMMARY OF THE INVENTION

The present invention includes a feeder for transferring material along a feed path. The feeder includes a conveyer which operates at a normal cyclical rate to feed the material; a sensor mounted on the feeder for detecting fault; a control system coupled with the conveyer and with the sensor. The control system responds to the sensor to slow the conveyer to a reduced cyclical rate when the sensor detects fault. The reduced cyclical rate is less than the normal cyclical rate to enable the feeder to properly feed the material.

When the conveyer operates at the reduced cyclical rate and the feeder begins to properly feed the material, the sensor ceases to detect fault. When the sensor ceases to detect fault, the control system speeds the conveyer back to the normal cyclical rate.

According to one aspect of the invention, the conveyer includes a rotatable drum. The drum has a periphery which defines an arcuate feed path. The rotatable drum includes grippers for gripping the material and transferring the material along the arcuate feed path.

According to another aspect of the invention, the conveyer includes a separator having a suction cup. The suction cup grips the material and transfers the material to the conveyer. The separator operates at a rate dependent on the conveyer cyclical rate. When the conveyer operates at the reduced cyclical rate, the separator has more time to grip the material as compared to when the conveyer operates at the normal cyclical rate.

According to another aspect of the invention, the feeder includes a conveyer which is flat and defines a linear feed path. In a variation of this aspect of the invention, the sensor mounts on the conveyer.

According to another aspect of the invention, the control system slows the conveyer in response to detection of fault and speeds the conveyer in response to failure to detect fault.

BRIEF DESCRIPTION OF THE DRAWING

For a further understanding of the various aspects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
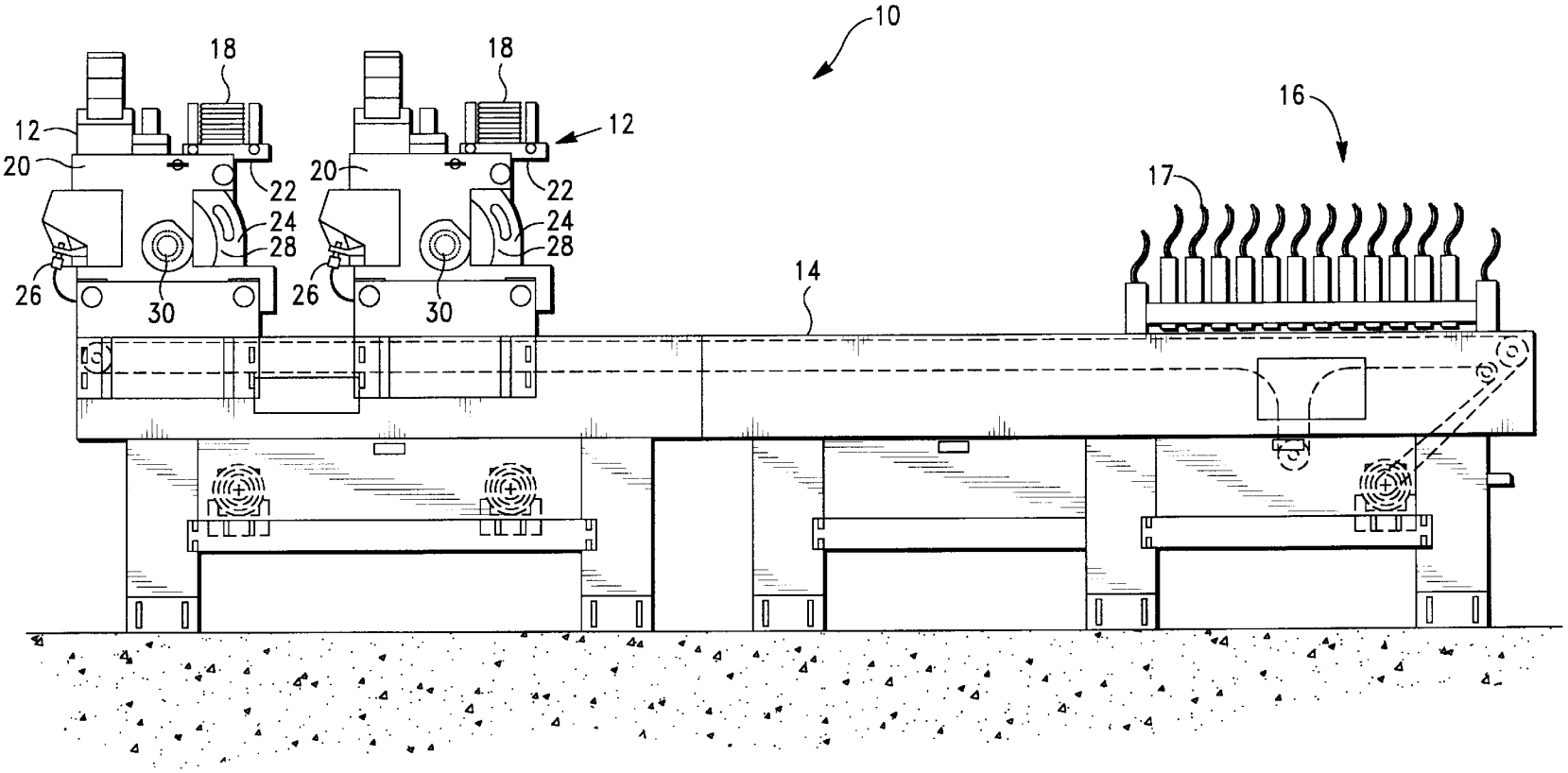
FIG. 1 is a schematic view of a bindery system in accordance with the present invention.

The invention will now be described with respect to FIG. 1, which illustrates a bindery machine system, shown generally by the reference numeral 10. The bindery machine system 10 includes a pair of feeders 12; a mail table 14 and a bindery machine 16. The feeders 12 and the bindery machine 16 mount on the mail table 14. Material 18 is stacked in each feeder 12 and is fed through the feeders 12, along the mail table 14 and to the bindery machine 16.

In one embodiment of the invention, the bindery machine 16 includes a cover printer 17. It can be appreciated, however, that the bindery machine may also include various of a number of machines such as saddle stitchers, adhesive binders and any of various other machines which process material fed by the feeders 12. A more complete definition of the term "bindery machine" follows.

Each feeder 12 includes a frame 20, a platform 22, a conveyer 24, and a sensor 26. The platform 22 mounts on the frame 20. The platform 22 aligns in parallel to the mail table 14. Although the platform 22 aligns in parallel to the mail table 14, it can be appreciated that alternate embodiments of the feeder 12 may include a platform 22 which extends vertically, or at an oblique angle with respect to the mail table 14.

The conveyer 24 includes a rotatable drum 28 which defines an arcuate feed path. The rotatable drum 28 has a hub 30 which rotatably mounts on the frame 20. The drum 28 aligns axially with the hub 30 so that the drum 28 extends across the mail table 14. When the drum 28 rotates, the drum 28 transfers material along the arcuate feed path from the platform 22, past the sensor 26 to the mail table 14. In a preferred embodiment, the drum 28 is fabricated from at least two planar disks which attach to the hub 30. The feeder 12 and the conveyer 24 operate at a normal cyclical rate. This normal cyclical rate is adjustable. Each cycle feeds one unit of material 18.

Although a conveyer 24 having a drum 28 is disclosed, it can be appreciated that the conveyer may assume any of a variety of configurations in accordance with the present invention. The conveyer 24 may, for example, be defined anywhere along a feed path such as on the mail table 14. The conveyer 24 may be flat, arcuate, or any other suitable shape to enable the material 18 to be fed from the platform 22 along a feed path.

Figure 2:
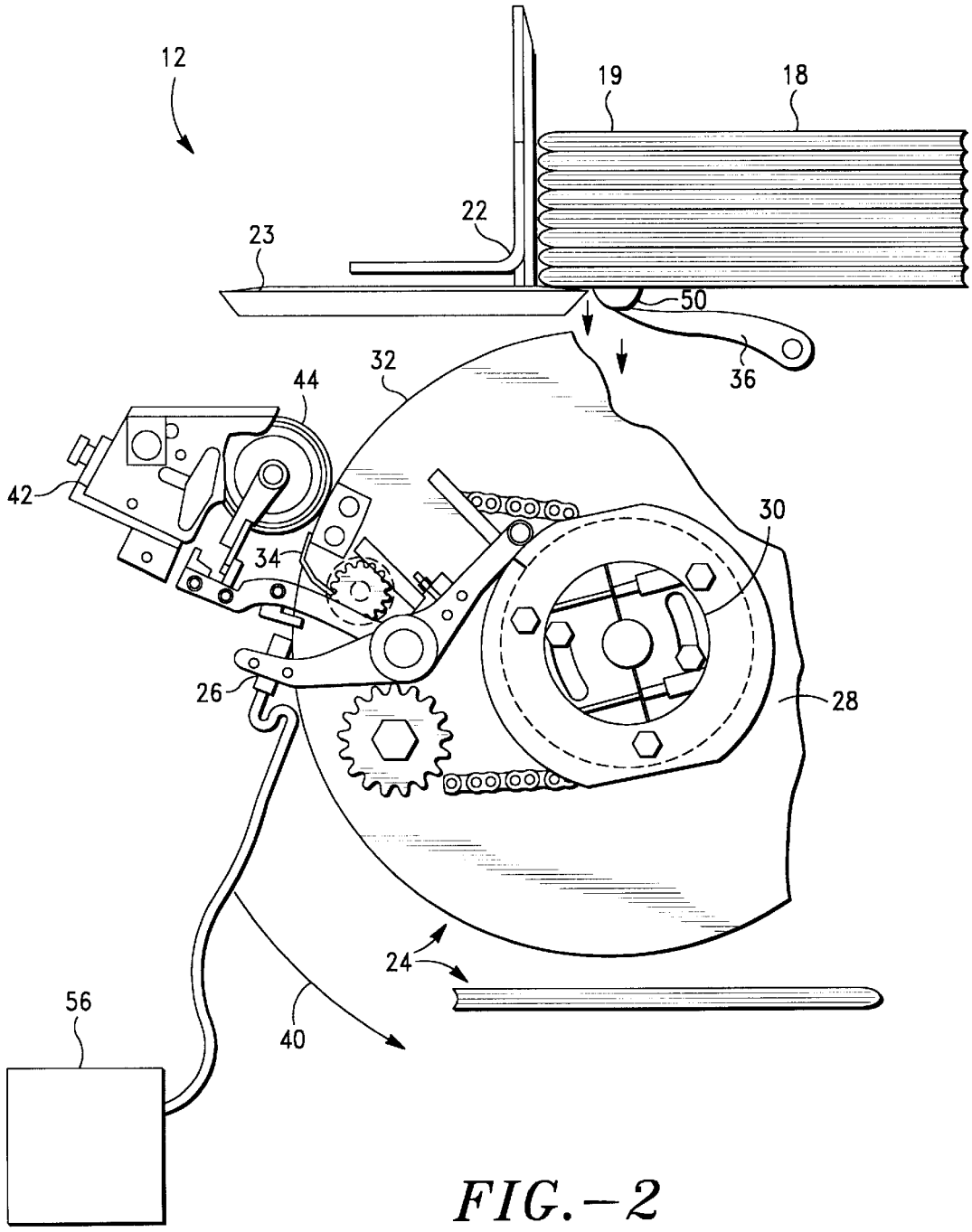
FIG. 2 is side view of the feeder of FIG. 1 having a rotatable drum.

With particular reference to FIG. 2, there is shown a portion of the feeder 12 including the drum 28, the sensor 26, the platform 22, a separator disk 23 and a separator 36. In one embodiment, the material 18 includes a stack of covers. In another embodiment, the material 18 includes a stack of signatures 19 which are supported by the platform 22. The separator 36 mounts adjacent the platform 22 to individually separate the material 18 and transfer the material towards the drum 18. It can be appreciated that the material may include any of a variety of sheet articles which may be stacked and transferred. Accordingly, the material 18 may include inserts, magazines, books, newspapers and other printed sheet articles.

The drum 28 includes a radial periphery 32 having at least one gripper 34 for gripping the material 18. The hub 30 is chain driven to rotate the drum 28. The drum 28 rotates to move the radial periphery 32 in the direction of the arrow 40.

The sensor 26 includes a caliper 42 having a caliper wheel 44. The caliper wheel 44 mounts on the feeder 12 adjacent the radial periphery 32 of the drum 28. The wheel 44 is rotatable and engages the radial periphery 32 of the drum 28. When material 18 is fed along the radial periphery 32 of the drum 28, the material 18 passes between the radial periphery 32 and the caliper wheel 44.

The caliper wheel 44 moves in response to the material 18. The material 18 has a thickness. The caliper wheel 44 moves in an amount proportional to the thickness of the material 18. The caliper 42 includes the sensor 26 which selectively signals material presence and material absence when the material 18 passes between the caliper wheel and the drum 28.

The separator 36 includes a suction cup 50. The suction cup 50 contacts a single sheet of material 18 to grip the material 18. Vacuum pressure within the suction cup 50 enables the separator to pull the single sheet of material towards drum 28. The separator 36 reciprocates to grip and pull the sheets of material 18 from the platform 22 to the drum 28. It can be appreciated that the suction cup 50 will normally grip a sheet of material 18 in an instant.

Factors such as ambient temperature, humidity, and material characteristics such as folds and wrinkles may effect operation of the suction cup 50. Under some conditions, proper operation of the suction cup 50 may require more time than the usual instant. Accordingly, the present invention enables a way to provide the suction cup an increased amount of time to grip material 18 when the normal instant of time is insufficient.

Although a separator 36 having a suction cup 50 is shown many types of separators may be used in accordance with the present invention. Friction type separators, for example, may be used. Additionally, various vacuum type and other separators may be used which do not rely on the paradigm suction cup design.

Figure 3:
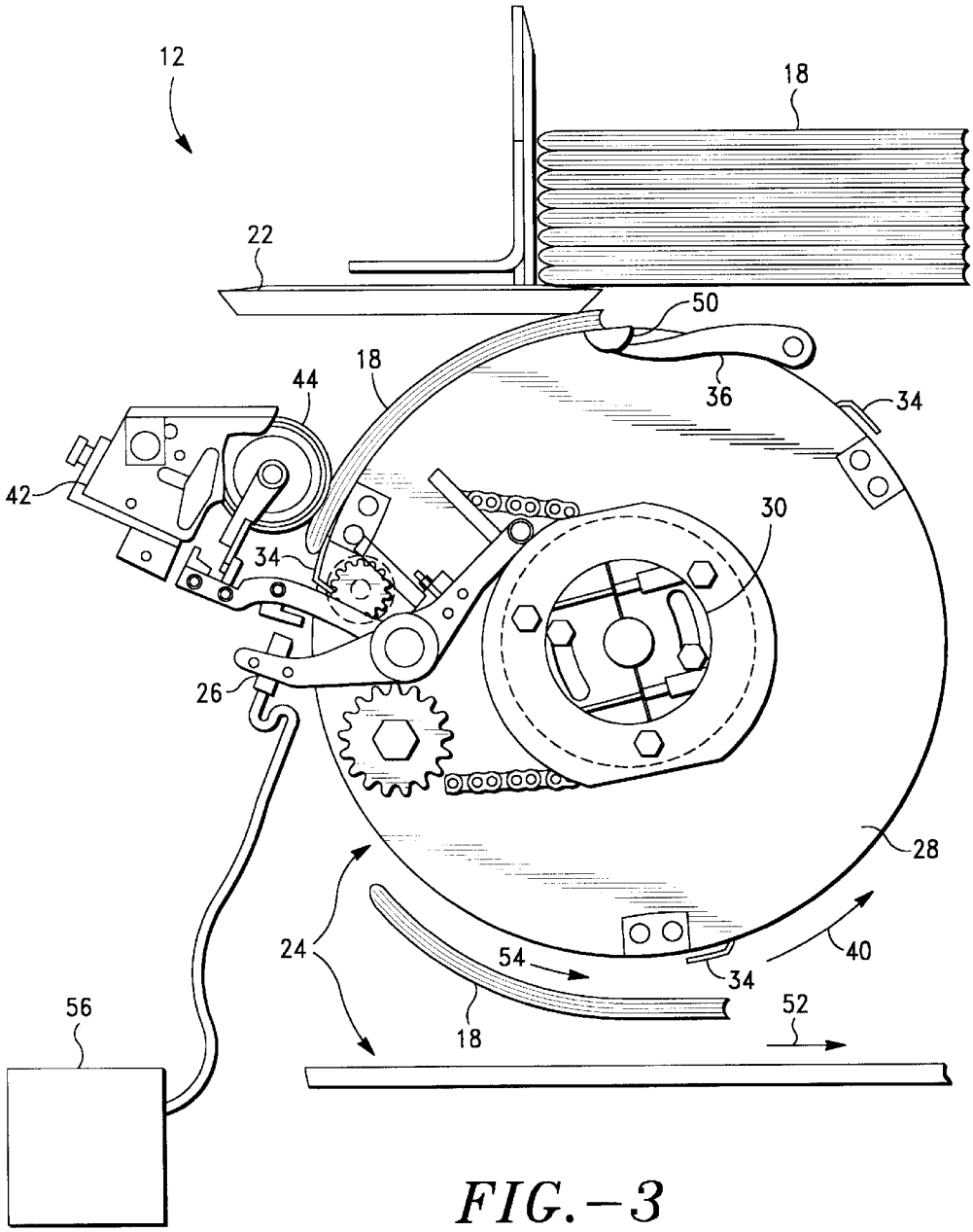
FIG. 3 is a side view of the feeder of FIG. 2 feeding material in accordance with the present invention.

With particular reference to FIG. 3, there is shown the drum 28 rotating and transferring the material 18 to the conveyer 24. As the drum 28 rotates in the direction of the arrow 40, the separator 36 contacts, grips and separates a single sheet of material 18 from the platform 22. The gripper 34 of the drum 28 pulls the material 18 from the separator 36 to the periphery 32 of the drum 28. The feeder 12 includes the sensor 26 which detects the thickness of each unit of material 18.

The gripper 34 grips a single sheet of the material 18 and draws the sheet of material 18 between the drum 28 and the caliper wheel 44. Further rotation of the drum 28 in the direction of the arrow 40 transfers the material 18 on to the conveyer 24.

The periphery 32 of the drum 28 and the conveyer 24 define a feed path generally designated with the reference numeral 54. The material 18 moves along the feed path 54 while the feeder 12 operates.

The sensor 26 of the caliper 42 measures the thickness of each sheet of material 18 to detect fault in the feeding process. Fault includes mis-feeds where material 18 fails to feed. Fault also includes the circumstance when the number of sheets of material fed exceeds a predetermined range. Typically, only one sheet of material 18 is desired to be fed and any number of sheets of material exceeding one is considered a fault. A folded or wrinkled signature 19 may cause a fault such as a mis-feed.

The feeder 12 includes a control system 56. The sensor 26 couples with the control system 56 to communicate fault to the control system upon detection of fault. The control system 56 regulates operation of the feeder 12 and regulates the rate at which the drum 28 rotates the rate at which, the separator feeds material 18 and the rate at which the conveyer conveys material 18. The control system 56 normally rotates the drum 28 at a normal cyclical rate. The rate at which the drum 28 rotates is variable and is regulated by the control system 56.

Figure 4:
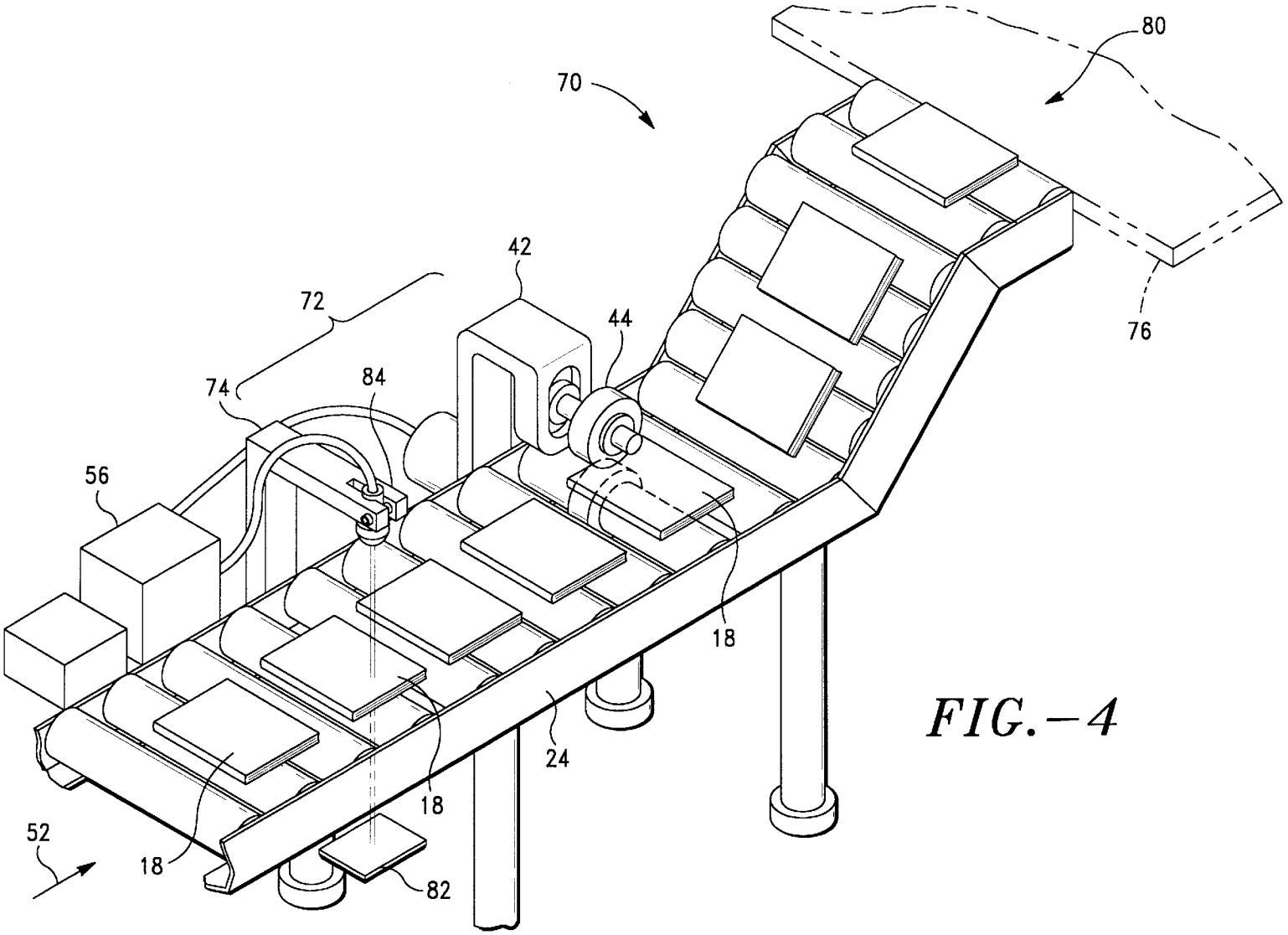
FIG. 4 is a perspective view of a feeder having a linear conveyer in accordance with the present invention.

FIG. 4 shows an embodiment of a feeder generally designated with the reference numeral 70. The feeder 70 includes the conveyer 24, the control system 56 and a sensor system generally designated with the reference numeral 72. The sensors system 72 includes a mis-eye assembly 74 and the caliper 42. The feeder 70 and the conveyer 24 operate at a normal cyclical rate to periodically deliver the material 18 to a bindery machine 76.

The term "bindery machine" as used herein is defined as any machine normally used in a bindery for printing and binding material. Bindery machines including cover printers, saddle stitchers, adhesive binders, gatherers, cutters, signature folders, etc. are contemplated by the present definition of bindery machine. Examples of various bindery machines are disclosed in U.S. Pat. No. 5,349,979 to Hall et al.; U.S. Pat. No. 5238,240 to Prim et al.; U.S. Pat. No. 5,197,590 to Prim et al.; U.S. Pat. No. 5,374,050 to Prim; and U.S. Pat. No. 5,092,236 to Prim et al., the disclosures of which are incorporated herein by reference.

The conveyer 24 defines a linear feed path generally designated with the reference numeral 80. The conveyer 24 transfers the material 18 along the linear feed path 80 in the direction of the arrow 52. The feeder 70 and the conveyer 24 operate at a normal cyclical rate, periodically feeding a desired amount of the material 18 to the bindery machine 76.

The sensor system 72 of the feeder 70 mounts on the conveyer 24 for detecting fault. Although the sensor system 72 mounts on the conveyer 24, it can be appreciated that the sensor system 72 may also be mounted at any suitable location along the feed path 80, including on the bindery machine 76, or on any other suitable location on the feeder 70.

The control system 56 electronically couples with the conveyer 24 and with the sensor system 72. The control system 56 slows the conveyer 24 from the normal cyclical rate to a reduced cyclical rate when the sensor system 72 detects fault. The reduced cyclical rate is less than the normal cyclical rate to enable the fault to be self-corrected by the feeder 70. Correction of fault may be accomplished due to feeding the material 18 at the reduced cyclical rate.

During operation of the conveyer 24 at the reduced cyclical rate, and when fault is no longer detected by the sensor system 72, the control system 56 automatically accelerates the conveyer 24 to a cyclical rate which exceeds the reduced cyclical rate. Preferably, the control system 56 accelerates the conveyer 24 to the normal cyclical rate.

The mis-eye assembly 74 has an electronic eye 84 and a reflector 82. When the material 18 passes between the electronic eye 84 and the reflector 82, the electronic eye 84 detects the presence of the material 18. During normal operation of the feeder 70, the material 18 periodically passes by the mis-eye assembly 74 at the cyclical rate at which the conveyer 24 and thus the feeder 70 operate. When the material 18 fails to pass between the reflector 82 and the electronic eye 84 at expected intervals, the mis-eye assembly 74 signals a fault to the control system 56.

The control system 56 decelerates the conveyer 24 in response to detection of a series of consecutive faults. According to one aspect of the invention, the control system 56 decelerates the conveyer 24 to the reduced cyclical rate after the sensor system 72 detects two consecutive faults. It can be appreciated, however, that the control system 56 may be programmable to respond to the sensor system 72 after any desired sequence of faults.

The reduced cyclical rate is about half of the normal cyclical rate. In another variation of the invention, the reduced cyclical rate is less than half the normal cyclical rate.

The control system 56 establishes a slow down period during which the conveyer 24, and the feeder 70 generally, decelerate and operate at the reduced cyclical rate. According to one aspect of the invention, the slow down period lasts at least three cycles. A cycle is defined as being the periodic movement of the conveyer 24 and the feeder 70 generally, which result in the delivery of one unit of material 18.

During the slow down period, the feeder 70 has two options. The feeder 70 may stop, or the feeder 70 may resume operation at the normal cyclical rate. When the sensor system 72 ceases to detect fault, the control system 56 accelerates the conveyer 24 to the normal cyclical rate. Alternatively, when the sensor system 72 continues to detect fault, the control system 56 automatically stops the feeder 70 after a predetermined number of material cycles.

Figure 5:
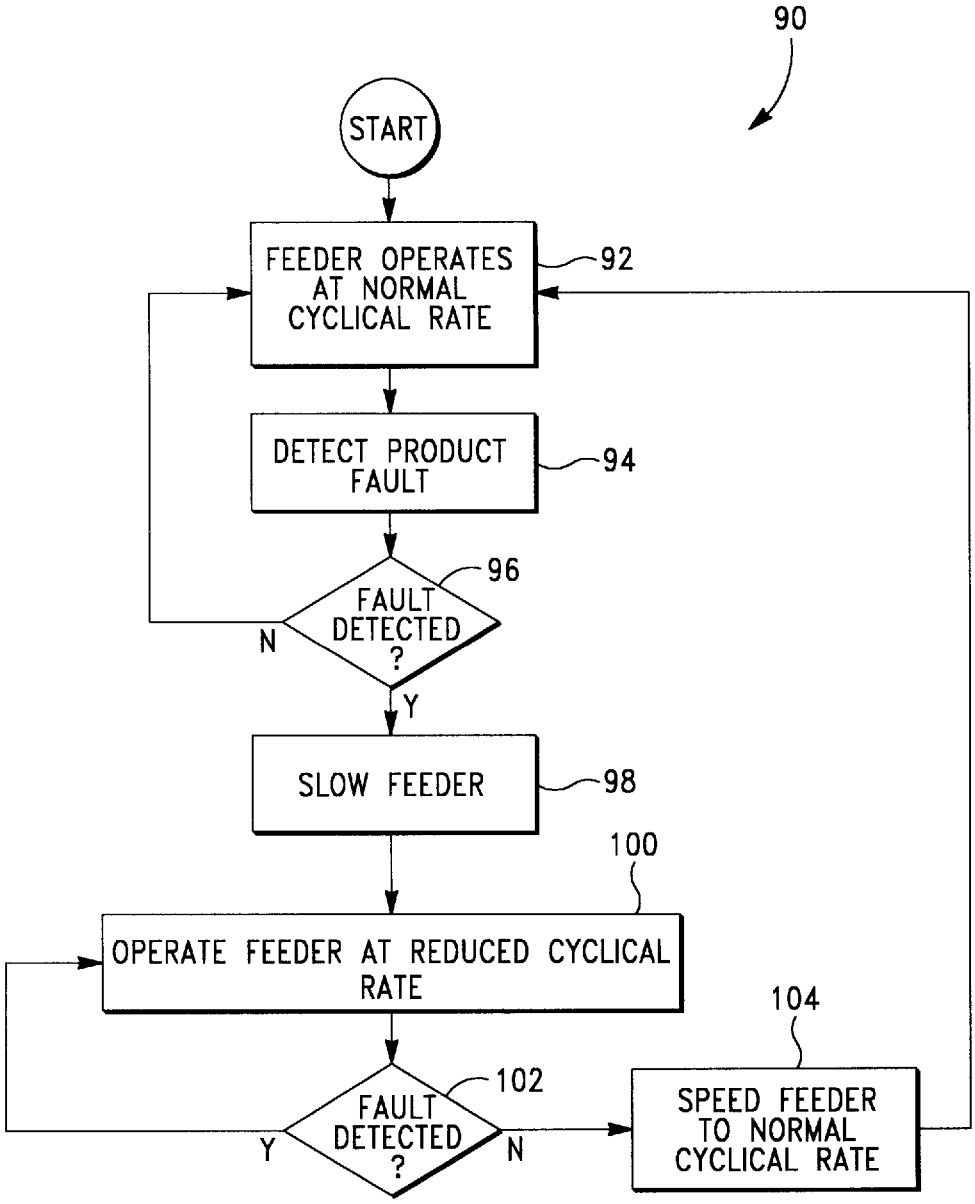
FIG. 5 is a flow chart of a method of operating a feeder in accordance with the present invention.

With particular reference to FIG. 5, there is shown a method of operating a feeder in accordance with the present invention which is generally designated with the reference numeral 90. The method is particularly useful for operating a feeder to feed stacked material. The method includes the step 92 of operating the feeder at a normal cyclical rate. Operation of the feeder at the normal cyclical rate transfers material along the feed path and causes the conveyer to operate at the normal cyclical rate.

The method includes the step 94 of detecting a fault. Upon detection of fault, designated 96, the step of slowing the feeder 98 commences. Upon failure to detect product fault, the step 92 of operating the feeder and conveyer at the normal cyclical rate commences.

The method includes the step 98 of slowing the feeder and conveyer to a reduced cyclical rate in response to detection of the fault. The step 100 of operating the feeder and conveyer at the reduced cyclical rate follows.

Optimally, operating the feeder and conveyer at the reduced cyclical rate will enable the feeder to self-correct any feeding problem which may have caused the fault. Slowing the feeder and conveyer enables the feeder to more reliably feed and transfer material. The reduced cyclical rate is relatively less than the normal cyclical rate. According to one aspect of the invention, the step 98 of slowing the feeder decelerates the feeder to approximately half of the normal cyclical rate to enable the feeder to transfer material without fault.

The step of detecting fault 102 follows the step 100 of operating the feeder at the reduced cyclical rate. When fault is detected, the step 100 of operating the feeder at the reduced cyclical rate continues. When fault is no longer detected, the step 104 of speeding the feeder and conveyer commences. The feeder is accelerated to above the reduced cyclical rate. Preferably, step 92 of operating the feeder at the normal cyclical rate repeats.

According to one aspect of the invention, the feeder includes a conveyer as shown in FIGS. 1–3. The method includes the step of gripping the material and transferring the material to the conveyer with a separator. The separator operates at a rate dependent on the rate at which the conveyer operates (e.g. the normal cyclical rate). When the conveyer slows to the reduced cyclical rate, the separator has more time to grip the material as compared to when the conveyer operates at the normal cyclical rate.

Figure 6:
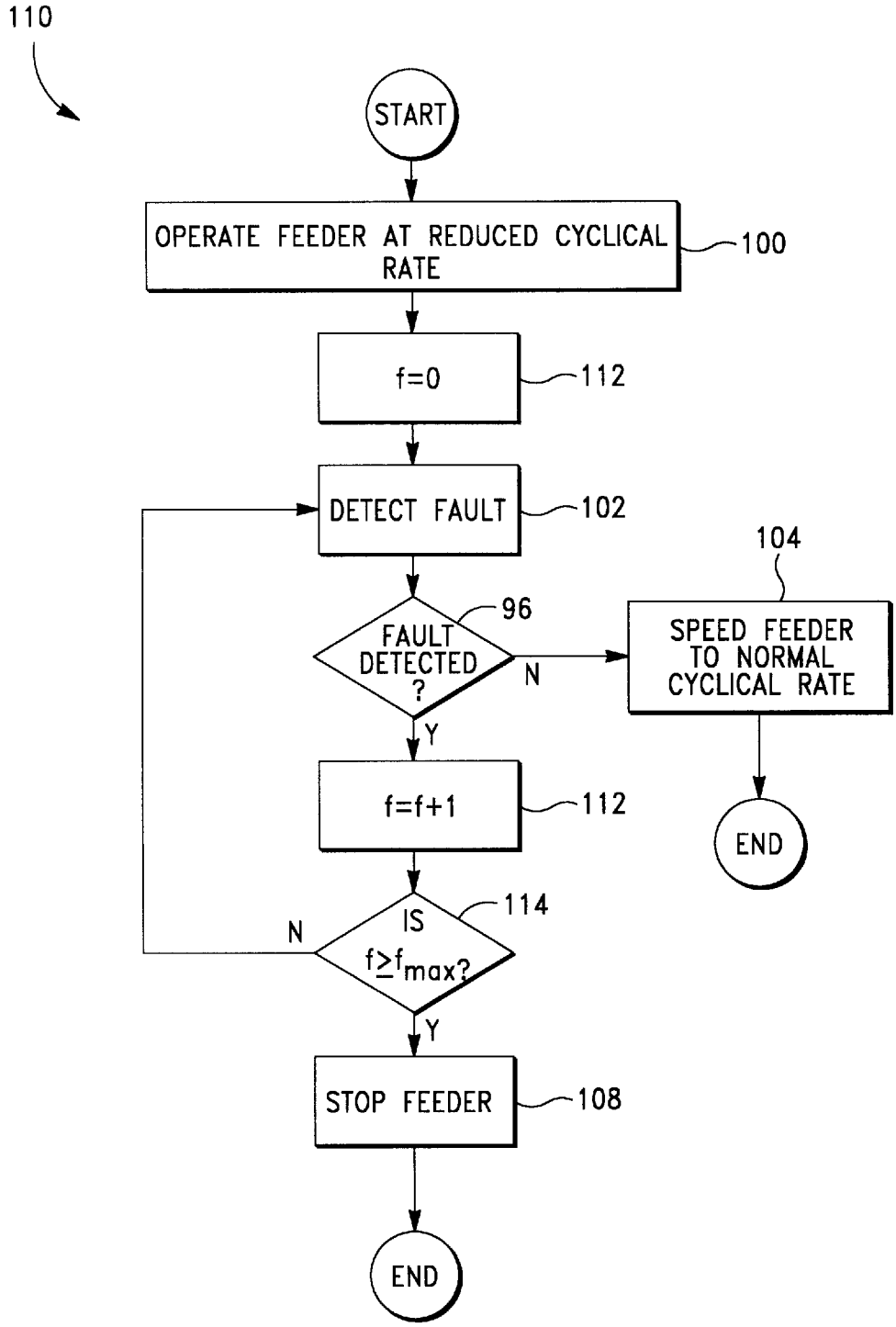
FIG. 6 is a flow chart of a method of operating a feeder in accordance with the present invention.

With particular reference to FIG. 6, there is shown a method of operating, and in particular, restarting the feeder. This method is generally designated with the reference numeral 110. The method includes the step 100 of operating the conveyer at the reduced cyclical rate; the step 102 of detecting fault with the sensor while the feeder operates at the reduced cyclical rate; the step 104 of speeding the feeder to the normal cyclical rate when the sensor ceases to detect fault; and the step 108 of stopping the conveyer when the conveyer operates at the reduced cyclical rate.

This method includes counting a sequence of faults to determine whether the fault will be self correcting after a few cycles or not. Counting includes the step 112 of initialization. The step 112 of initialization sets the number of detected faults to zero. A predetermined number of fault cycles is established to limit the number of cycles at which the feeder operates at the reduced cyclical rate. The predetermined number of faults is represented by $f_{max}$. In a preferred embodiment, $f_{max}$ is within the range of 2–6 cycles. Each cycle feeds one unit of material.

When a series of faults occurs, each fault is detected 96 and the counter adds one to the number of faults f=f+1. The step 114 of determining whether the number of faults equals or exceeds the predetermined number faults is performed and represented by $f \geqq f_{max}$. When fault is not corrected during the predetermined number of cycles, the step 108 of stopping the feeder is performed.

According to one aspect of the invention the method includes the step of establishing a predetermined range of acceptable material thickness. The sensor detects the material thickness while material is transferred along the feed path. The sensor signals fault upon detection of a material thickness which exceeds the predetermined range.

While the foregoing detailed description has described several embodiments of the feeder in accordance with this invention, it is to be understood that the above description is illustrative only and not limiting of the disclosed invention. Particularly, the feeder and method may be used in conjunction with any of multiple types of bindery machine systems. Multiple sensor types may be used and these sensors may be mounted in any convenient location respecting the feeder 12. It will be appreciated that the embodiments discussed above and the virtually infinite embodiments that are not mentioned could easily be within the scope and spirit of this invention. Thus, the invention is to be limited only by the claims as set forth below.

What is claimed is:

1. A feeder for feeding material along a feed path, comprising:

a conveyer which operates at a normal cyclical rate to transfer the material, the conveyer including a rotatable drum having a periphery, the periphery of the drum defining an arcuate feed path, the periphery including grippers for gripping the material and transferring the material along the arcuate feed path;

a sensor mounted on the feeder for detecting fault;

a control system coupled with the conveyer and with the sensor, the control system being responsive to the sensor to regulate the rate at which the conveyer operates, the control system slows the conveyer to a reduced cyclical rate in response to the detection of fault, the control system being capable of speeding the conveyer when the sensor ceases to detect fault, the reduced cyclical rate being less than the normal cyclical rate, whereby, when the conveyer operates at the reduced cyclical rate and ceases to detect fault, the control system speeds the conveyer.

2. A feeder for feeding material along a feed path, comprising:

a conveyer which operates at a normal cyclical rate to transfer the material, the conveyer including a separator having a suction cup for gripping the material and transferring the material to the conveyer, the suction cup gripping the material at discrete intervals during the conveyer cycle, whereby the conveyer operates at the reduced cyclical rate to provide the suction cup time to grip the material;

a sensor mounted on the feeder for detecting fault;

a control system coupled with the conveyer and with the sensor, the control system being responsive to the sensor to regulate the rate at which the conveyer operates, the control system slows the conveyer to a reduced cyclical rate in response to the detection of fault, the control system being capable of speeding the conveyer when the sensor ceases to detect fault, the reduced cyclical rate being less than the normal cyclical rate, whereby, when the conveyer operates at the reduced cyclical rate and ceases to detect fault, the control system speeds the conveyer.

3. A feeder for feeding material along a feed path, comprising:

a platform for holding a stack of material;

a separator moveably attached to the platform; the separator having a suction cup for gripping the material and transferring the material;

a conveyer having a rotatable drum with a periphery, the periphery of the drum defines an arcuate feed path, the rotatable drum includes grippers for gripping the material from the separator and transferring the material along the arcuate feed path, the drum rotates at a normal cyclical rate;

a sensor mounted on the feeder for detecting fault; and a control system coupled with the conveyer and with the sensor, the control system being responsive to the sensor to slow the conveyer to a reduced cyclical rate when the sensor detects a fault, the reduced cyclical rate being less than the normal cyclical rate, whereby, when the conveyer operates at the reduced cyclical rate and fault is no longer detected, the control system speeds the conveyer.

4. An apparatus as set forth in claim 3, wherein the suction cup grips the material at discrete intervals during the conveyer cycle, whereby the suction cup has more time to grip the material at the reduced cyclical rate than at the normal cyclical rate.

5. An apparatus as set forth in claim 3, wherein the sensor includes a caliper having a rotatable wheel, the drum has a periphery, the material passes between the rotatable wheel and the periphery of the drum to enable the wheel to contact the material to sense the thickness of the material.

6. An apparatus as set forth in claim 3, wherein the material includes signatures, the separator rotates to individually grip each signature and transfer each signature along the feed path.

7. An apparatus as set forth in claim 3, wherein the control system corrects the fault when the control system slows the conveyer, the control system speeds the conveyer to the normal cyclical rate when the fault is corrected and the sensor fails to detect fault.

* * * * *